United States Patent [19]

Stadler

[11] Patent Number: 4,598,568

[45] Date of Patent: Jul. 8, 1986

[54] BENDING DEVICE FOR OFFSET PRINTING PLATES

[75] Inventor: Lothar Stadler, Eppelheim, Fed. Rep. of Germany

[73] Assignee: Heidelberger Druckmaschinen AG, Heidelberg, Fed. Rep. of Germany

[21] Appl. No.: 672,803

[22] Filed: Nov. 19, 1984

[30] Foreign Application Priority Data

Nov. 19, 1983 [DE] Fed. Rep. of Germany ..... 3341924

[51] Int. Cl.[4] ..... B21D 5/04

[52] U.S. Cl. ..... 72/320; 72/323

[58] Field of Search ..... 72/319-323, 72/306, 304, 305, 384

[56] References Cited

U.S. PATENT DOCUMENTS

| | | | |
|---|---|---|---|
| 412,254 | 10/1889 | Hastings | 72/323 |
| 864,325 | 8/1907 | McDonald | 72/320 |
| 1,710,985 | 4/1929 | Jacobsen | 72/323 |
| 2,190,423 | 2/1940 | Henricson | 72/323 |
| 3,677,059 | 7/1972 | Miller et al. | 72/403 |

FOREIGN PATENT DOCUMENTS

| | | | |
|---|---|---|---|
| 38263 | 10/1978 | Japan | 72/322 |
| 983523 | 2/1965 | United Kingdom | 72/384 |

*Primary Examiner*—Daniel C. Crane

*Attorney, Agent, or Firm*—Herbert L. Lerner; Laurence A. Greenberg

[57] ABSTRACT

Bending device for offset printing plates having a support plate formed with a head portion, a respective bending bar pivotally mounted at opposite ends of the head portion for bending respective ends of a printing plate disposed on the head portion, a lowerable downholder member for holding a printing plate down against the head portion, and a positioning device for bending the printing-plate ends in-register to given printing-plate dimensions, includes adjusting means disposed parallel to the support plate between the opposite ends of the support-plate head portion, the adjusting means being movable into a plane wherein a printing plate is disposed on the head portion, so as to deflect at least part of the printing plate out of the plane.

3 Claims, 5 Drawing Figures

BENDING DEVICE FOR OFFSET PRINTING PLATES

The invention relates to a bending device for offset printing plates and, more particularly, to such a bending device having a support plate formed with a head position, a respective bending bar pivotally mounted at opposite ends of the head portion for bending respective ends of a printing plate disposed on the head portion, a lowerable down-holder member for holding a printing plate down against the head portion, and a positioning device for bending the printing plate ends in-register to given printing-plate dimensions.

Heretofore known bending devices of this general type (German Published Prosecuted Application (DAS) 20 28 249) afford accurate bending of plate ends to given bending-plate dimensions. To align or orient printing plates prior to bending, the heretofore known bending devices employ positioning rails and positioning pins, respectively, so that the finally bent printing always assumes the same position with respect to the register of the printed image disposed thereon. The completed printing plate is then clamped onto the plate cylinder, the tangential clamping force effecting a predetermined elongation or expansion of the plate. In positively locked clamping systems, the force of expansion or elongation corresponds to the applied clamping force, so that after the clamping occurs, the plate is seated well on the plate cylinder. In modern systems, to achieve a damping force which is always uniform, the plate is bent away slightly shorter than is required by purely theoretical development.

Since different types of plates are used in modern printing machines, such as aluminum plates, bimetallic plates or the like, it has become apparent that, when a heretofore known system for bending the offset plates is employed, one side or end of the bent away printing plate is torn off when the plate is clamped. This occurs when, for example, the bending device has been designed for a printing plate having a high elasticity, whereas a printing plate of lower elasticity is being bent and used. If, conversely, the bending device is designed for a printing plate of relatively lower elasticity, good seating of highly elastic plates on the plate cylinder is then no longer able to be assured.

It is accordingly an object of the invention to provide a bending device for offset printing plates which affords in-register clamping of a printing plate on positively locking clamping systems as are found, for example, in modern register systems, without damage to or destruction of the printing plate and, nevertheless, always assuring uniformly good seating of the plate on the plate cylinder.

With the foregoing and other objects in view, there is provided, in accordance with the invention, a bending device for offset printing plates having a support plate formed with a head portion, a respective bending bar pivotally mounted at opposite ends of the head portion for bending respective ends of a printing plate disposed on the head portion, a lowerable down-holder member for holding a printing plate down against the head portion, and a positioning device for bending the printing-plate ends in-register to given printing-plate dimensions, includes adjusting means disposed parallel to the support plate between the opposite ends of the support-plate head portion, the adjusting means being movable into a plane wherein a printing plate is disposed on the head portion, so as to deflect at least part of the printing plate out of the plane. The advantage of the invention is that, while employing relatively simple means and without time-consuming adjustment operations, it is possible to adjust the respective length of the bent plate to the correct elongation or expansion of the particular plate. When using a specific plate, the printing need only preselect the respective extent of deflection in order to attain the optimal length i.e. the optimal clamping, for this type of plate. The differences in length of the individual types of printing plates which must be taken into consideration are thereby very small and often amount to only fractions of a millimeter.

In accordance with another feature of the invention, the adjusting means include an eccentric shaft having an eccentric rotatable outer cylindrical surface engageable with the printing plate, by turning the shaft, so as to deflect the printing plate out of the plane in which it is disposed. The eccentric shaft, when having a very great parallelism with the support plate, permits a highly sensitive variation or change in the length of the bend, and is set by the printer in accordance with a concomitant feature of the invention, namely, the provision of a hand-wheel mounted on the eccentric shaft for turning the shaft, and scale means disposed adjacent the hand-wheel, the eccentric shaft being adjustable by the hand-wheel in accordance with the scale means.

Other features which are considered as characteristic for the invention are set forth in the appended claims. Although the invention is illustrated and described herein as embodied in bending device for offset printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
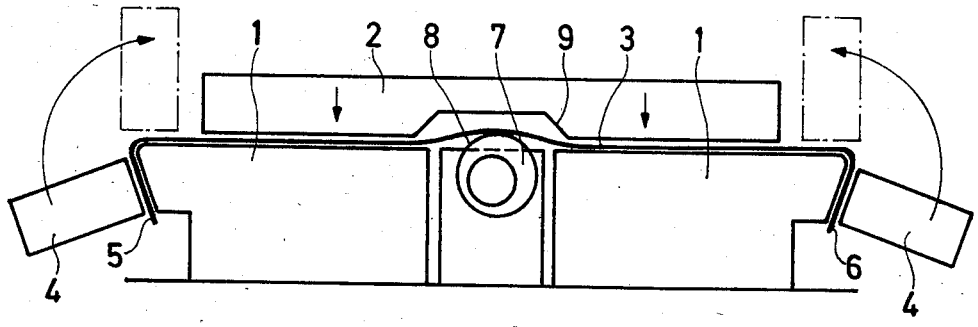
FIG. 1 is a diagrammatic side elevational view of a bending device according to the invention, with a deflected (lengthened) printing plate, (large bend length)
Figure 2:
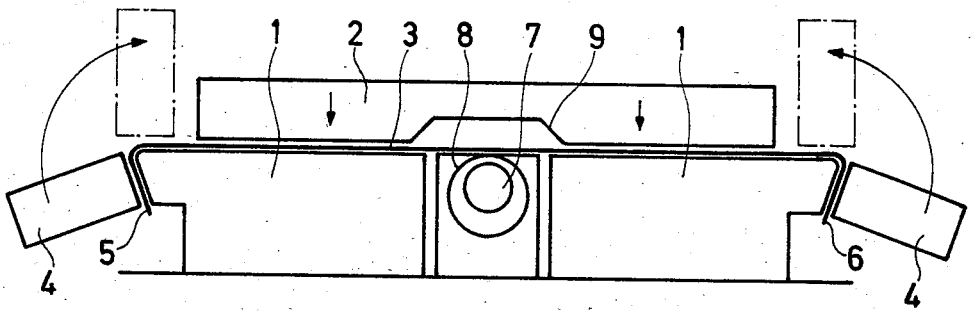
FIG. 2 is a view of the bending device similar to that of FIG. 1 wherein the printing plate has a minimal bend, (small bend length)

Referring now to the drawing and first, particularly, to FIGS. 1 and 2 thereof, there is shown a bending device formed of a support plate 1 and a lowerable down-holding member 2 between which a printing plate 3 is clamped. For in-register positioning of the printing plate, positioning means are known which are not shown in the drawing. Bending bars 4 are pivotally mounted on the support plate 1 at two opposite ends of a head of the support plate, the bending bars 4, as shown in phantom, being capable of assuming an upper starting position. After the printing plate has been inserted, the bending bars 4 are moved downwardly and thus bend the printing plate ends 5 and 6 downwardly in accordance with the angular shape of the head of the supporting plate 1. In the embodiment shown in FIG. 2, the dimension between the bent printing plate ends corresponds to the dimensional relations prescribed by the support plate 1. The two printing plate ends 5 and 6 thus extend precisely parallel with respect to one another and are angled off slightly shorter than would be required by the purely theoretical clamping length on the printing plate cylinder. The force necessary for elongating or expanding the plate exerts a tangential clamping force on the plate which ensures snug clamping of the latter and good seating thereof on the plate cylinder.

Approximately in the middle of the support plate 1 are adjusting means in the form of an eccentric shaft 7 which extends parallel to the support plate 1. By turning the eccentric shaft 7, it is possible to raise an eccentric outer cylindrical surface 8 or lesser extent relative to the plane in which the support plate 1 is disposed, so that when a new printing plate 3 is placed in position, it is deflected out of a straight line or the plane when clamped down by the down-holding member 2. For this purpose, a recess 9 is provided in the down-holding member 2. This deflection of the printing plate 3 out of the straight line or plane in which it is originally disposed causes a lengthening or expansion of the distance between the two bending edges on the support plate 1. This relatively small deflection makes it possible to reduce the strain of the clamped printing plate on the plate cylinder.

Figure 3:
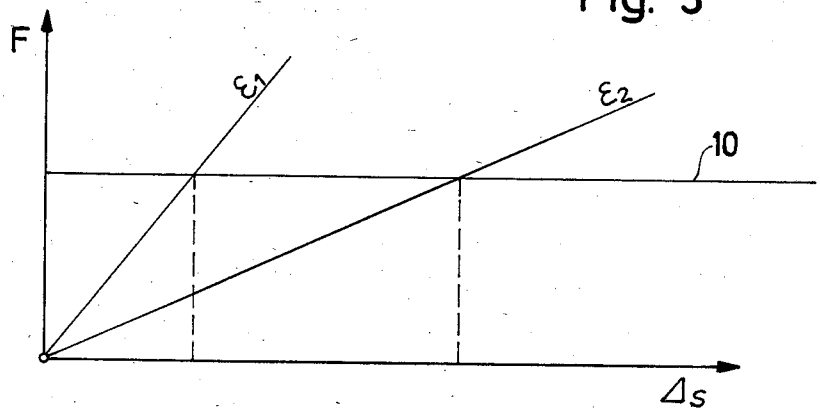
FIG. 3 is a plotted strain diagram for various printing plates.

FIG. 3 is a plot diagram showing the tangential clamping force F along the ordinate, and the strain travel $\Delta s$ along the abscissa. The straight line $\epsilon 1$ represents, for example, the increase in the strain in the case of an increasing clamping force for a bimetallic plate and $\epsilon 2$ the strain behavior of an aluminum plate. The line 10 represents the ideal clamping force, it being clearly apparent that the strain travel at $\Delta s$ is off different length for the two aforementioned types of printing plates.

Figure 4:
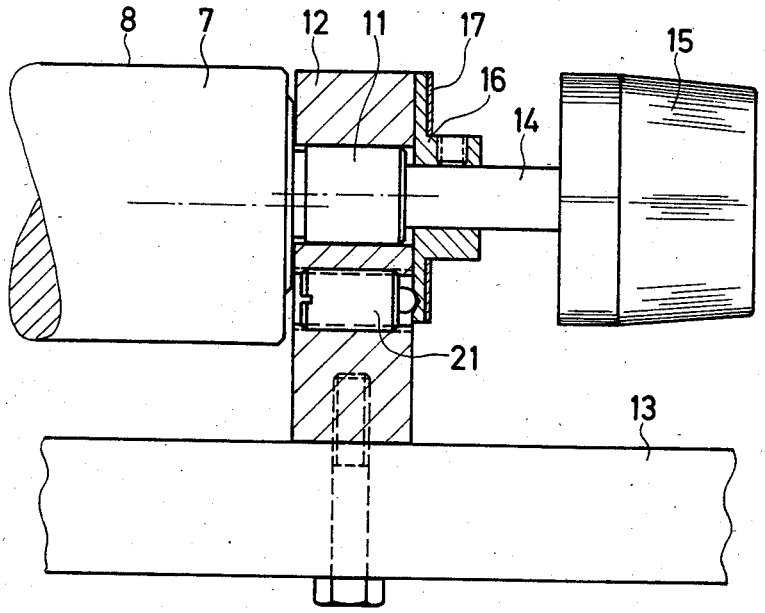
FIG. 4 is a somewhat enlarged, partial longitudinal sectional view of the eccentric shaft of FIGS. 1 and 2.
Figure 5:
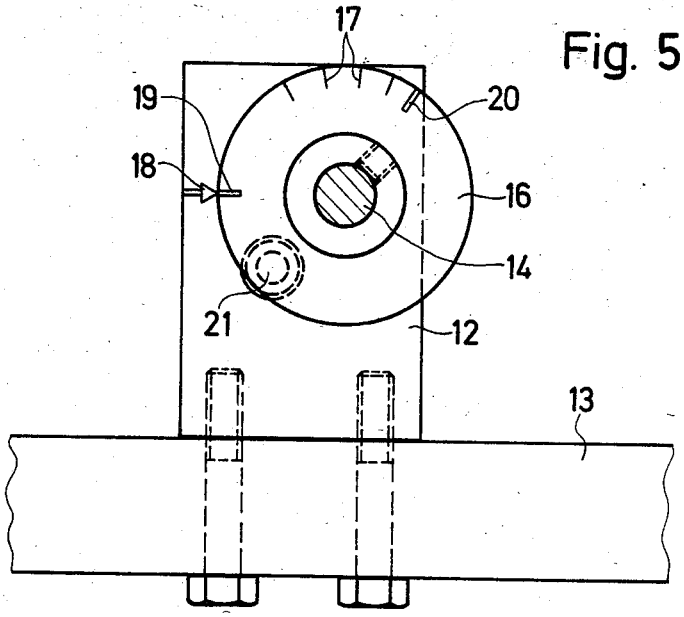
FIG. 5 is a side elevational view of FIG. 4 with the hand-wheel thereof removed, and showing the eccentric shaft and scale.

FIGS. 4 and 5 show the eccentric shaft 7 with its eccentrically offset journal 11 which is held in a bearing block 12 which, in turn, is mounted on a base plate 13 together with the support plate 1. Mounted on an extension 14 of the journal 11 is a hand-wheel 15 by means of which the eccentric shaft 7 can be turned with great sensitivity. Also mounted on the extension is a disc 16 with a scale 17 which, in conjunction with an arrow 18, indicates the respective adjustment position or setting. The setting 19 might, for example, be provided for the aluminum plate, and the setting 20 for the bimetallic plate. To prevent an unintentional misadjustment, a spring-supported ball-type catch 21 is provided.

There are claimed:

1. Bending device for offset printing plates having a support plate formed with a head portion for supporting said printing plate, a respective bending bar pivotally mounted at opposite ends of the head portion for bending respective ends of a printing plate disposed on the head portion, said head portion extending between said opposite ends lying within a single plane, a lowerable down-holder member movable relative to said head portion for holding a printing plate down against the head portion, and a positioning device for bending the printing-plate ends inregister to given printing-plate dimensions, comprising adjusting means disposed parallel to the support plate between the opposite ends of the support-plate head portion, said adjusting means being selectively movable into said plane wherein a printing plate is disposed on said head portion, so as to deflect at least part of the printing plate extending between the bend ends thereof.

2. Bending device for offset printing plates having a support plate formed with a head portion, a respective bending bar pivotally mounted at opposite ends of the head portion for bending respective ends of a printing plate disposed on the head portion, a lowerable down-holder member for holding a printing plate down against the head portion, and a positioning device for bending the printing-plate ends in-register to given printing-plate dimensions, comprising adjusting means disposed parallel to the support plate between the opposite ends of the support-plate head portion, said adjusting means being movable into a plane wherein a printing plate is disposed on said head portion, so as to deflect at least part of the printing plate out of said plane, said adjusting means comprising an eccentric shaft having an eccentric rotatable outer cylindrical surface engageable with the printing plate, by turning said shaft, so as to deflect the printing plate out of the plane in which it is disposed.

3. Bending device according to claim 2 including a hand-wheel mounted on said eccentric shaft for turning said shaft, and scale means disposed adjacent said hand-wheel and traversible by an indicator movable with said hand-wheel, said eccentric shaft being adjustable by said hand-wheel to an adjustment setting in accordance with a reading of said scale means.

* * * * *